US005311718A

United States Patent [19]

Trousilek

[11] Patent Number: 5,311,718

[45] Date of Patent: May 17, 1994

[54] FORM FOR USE IN FABRICATING WALL STRUCTURES AND A WALL STRUCTURE FABRICATION SYSTEM EMPLOYING SAID FORM

[76] Inventor: Jan P. V. Trousilek, 9 Guerney Ct., Newport, R.I. 02540

[21] Appl. No.: 908,286

[22] Filed: Jul. 2, 1992

[51] Int. Cl.[5] ..... E04B 2/00

[52] U.S. Cl. ..... 52/425; 52/421; 52/439; 52/436

[58] Field of Search ..... 52/580, 586, 588, 425, 52/593, 595, 286, 293, 415, 421, 436, 439, 80.5, 588, 408, 410, 442

[56] References Cited

U.S. PATENT DOCUMENTS

| | | | |
|---|---|---|---|
| 2,701,464 | 2/1955 | Kyle et al. | 52/421 |
| 3,438,165 | 4/1969 | Morawski . | |
| 3,440,785 | 4/1969 | Denny et al. . | |
| 3,509,673 | 5/1970 | Witkosky et al. . | |
| 3,668,832 | 6/1972 | Harman . | |
| 3,780,481 | 12/1973 | Tomkins | 52/265 |
| 3,782,049 | 1/1974 | Sachs . | |
| 4,104,837 | 8/1978 | Naito | 52/173 R |
| 4,186,160 | 1/1980 | Landreth | 264/34 |
| 4,299,070 | 11/1981 | Oltmanns et al. . | |
| 4,438,614 | 3/1984 | Raith et al. | 52/580 |
| 4,439,967 | 4/1984 | Dielenberg | 52/309.12 |
| 4,532,745 | 8/1985 | Kinard . | |
| 4,698,947 | 10/1987 | McKay . | |
| 4,706,429 | 11/1987 | Young . | |
| 4,731,968 | 3/1988 | Obino . | |
| 4,860,515 | 8/1989 | Browning, Jr. . | |
| 4,884,382 | 12/1989 | Horobin | 52/426 |
| 4,889,310 | 12/1989 | Boeshart . | |
| 4,894,969 | 1/1990 | Horobin | 52/309.12 |
| 5,014,476 | 5/1991 | Leslie et al. . | |
| 5,014,478 | 5/1991 | Spring . | |
| 5,014,480 | 5/1991 | Guarriello et al. . | |
| 5,038,541 | 8/1991 | Gibbar, Jr. . | |
| 5,040,344 | 8/1991 | Durand . | |

FOREIGN PATENT DOCUMENTS 0006027 of 1886 United Kingdom .

*Primary Examiner*—Carl D. Friedman
*Assistant Examiner*—Beth A. Aubrey
*Attorney, Agent, or Firm*—Kriegsman & Kriegsman

[57] ABSTRACT

A multi-component modular system for use in fabricating wall structures of the type which may be fortified with concrete or other similar materials. The system includes a plurality of plastic prefabricated forms, each form comprising an elongated, generally rectangular member having a cavity defined by a pair of side panels and a pair of end panels. One end panel has a pair of outwardly-facing, L-shaped flanges, and the other end panel has a pair of L-shaped slots sized and shaped to mate with the L-shaped flanges. Two or more forms may be interconnected in an end-to-end fashion by inserting the L-shaped flanges of one form into the L-shaped slots of a second form. A plurality of openings are provided on the end panels of the forms to permit concrete to be distributed monolithically between adjacent forms. Each of the forms may be supported by a strut member which is mountable transversely between the pair of side panels of the form. The form cavity may also be partitioned into a concrete-receiving space and a plurality of insulation spaces by mounting a plurality of divider panels longitudinally within the cavity in the form and spaced apart from the side panels. Panels mateable with either the left end or the right end of a form may additionally be used to contain the flow of concrete out of the ends of a wall structure and/or to join together a pair of forms in an end-to-side relationship. Where no foundation for the wall structure exists, a U-shaped bracket may be used to mount the forms into the ground.

3 Claims, 9 Drawing Sheets

FORM FOR USE IN FABRICATING WALL STRUCTURES AND A WALL STRUCTURE FABRICATION SYSTEM EMPLOYING SAID FORM

BACKGROUND OF THE INVENTION

The present invention relates generally to prefabricated forms of the type which are used to fabricate wall structures and more particularly to a new and improved prefabricated form for use in fabricating wall structures. The present invention also relates to a wall structure fabrication system which includes a plurality of said prefabricated forms and which can be used to fabricate various types of wall structures.

It is well-recognized that millions of people, both in the United States and abroad, lack some form of minimally-acceptable dwelling wherein refuge from both natural and man-made elements may be sought. Most often, this is because the costs associated with obtaining a structurally-sound dwelling, e.g., the cost of obtaining suitable building materials and the cost of employing skilled labor to fashion a building using such building materials, are prohibitive. For example, the fabrication of concrete walls for a dwelling is clearly rather complex and time-consuming as it requires both the strategic placement of steel bracings, wood form boards, and extensive exterior bracing to hold the form boards in the appropriate alignment while concrete is poured between the wood form boards and the subsequent removal of the wood form boards and exterior bracing once the concrete has been poured and allowed to harden into a wall.

Recently, a multitude of novel wall-forming systems have come into being, the systems making use of a plurality of hollow interconnected plastic forms into which concrete may be poured. After concrete is poured into the forms and allowed to harden, the forms remain in place to serve as insulation. Examples of patents relating to this type of wall-forming system are described below.

U.S. Pat. No. 5,038,541, to Gibbar, Jr., which issued Aug. 13, 1991, relates to a polymer building wall form construction. The construction comprises forms prefabricated of a polymer, such as polystyrene, which are assembled together, the forms being spaced apart by integrally connecting polymers or blocks, spacers, or spool means, erected upon a foundation footing, or other base structure, through their insertion of L-shaped ties, with the wall forms being erected to the height desired for the subject building or other structure, whether it be a commercial, industrial, or residential building, through the application of tee-shaped ties therebetween. Reinforcement is located in the spacing between the blocks or spacers, of the wall forms, and concrete may be poured therein, either at the job site, where the building is being constructed, or at the manufacturing plant, where the wall forms are formed, in order to provide a latticework of reinforced concrete for the composite wall. The internal surface of each of the inner and outer liners forming the wall form are shaped, into the configuration of an I-beam, in order that any concrete poured therein will undertake the cross-sectional configuration of an I-beam, to add further reinforcement to the fabricated building, once a wall is completed. A top beam form of plate cap is arranged upon the upper edge of the formed wall, with the concrete being poured simultaneously with the construction of the assembled wall. Bracing held together by ties and locked into position by fasteners secure the wall forms together, in their erected disposition, in preparation for the pouring of the latticework of concrete reinforced composite wall.

U.S. Pat. No. 5,014,480 to Guarriello et al., which issued May 14, 1991, relates to hollow foamed plastic forms for poured concrete. Each of the forms has a pair of opposed parallel side walls with planar upper and lower faces, and a pair of opposed end members. Disposed on the upper and lower faces of the side walls are a series of elongated locking members, each composed of a pair of offset ribs having a trapezoidal shape.

U.S. Pat. No. 4,894,969 to Horobin, which issued Jan. 23, 1990, relates to an insulating block form for constructing concrete wall structures. The block form is formed from expandable polystyrene material to provide a lightweight, rigid, box-like structure having a pair of oppositely disposed side walls and end walls which together define a body cavity to receive concrete therein. A plurality of transverse strut members integrally support the side walls and further define a plurality of cells. Each end wall includes a pair of inserts which are adapted to be mounted to the transverse strut member when the elongated block form is required to be cut for a particular installation. The side and end walls are further provided with interlocking members whereby they are readily stacked one above the other and side-to-side in a secure interlocked arrangement.

U.S. Pat. No. 4,884,382 to Horobin, which issued Dec. 5, 1989, relates to a modular building-block form. The form is shaped in a rectangular configuration and has a pair of oppositely disposed side panel members and end enclosure panels to define a body cavity to receive poured concrete therein. The side panels are held in a fixed parallel relation to each other and are further prevented from side-to-side movement relative to each other by a plurality of strut members which are fixedly mounted transversely from one side panel to the other. Each strut member is formed with substantially "H"-shaped tenon members that are slidably engaged with spaced-apart, "T"-shaped slots formed in the inner surfaces of said side panels. The panel structure is firmly grasped within the pair of opposed stud members that define the tenons. The tenons are integrally connected together by means of truss members that further define passages therethrough for flow of wet concrete therebetween.

Other patents of interest include U.S. Pat. No. 5,040,344 to Durand, which issued Aug. 20, 1991, U.S. Pat. No. 5,014,478 to Spring, which issued May 14, 1991, U.S. Pat. No. 5,014,476 to Leslie et al., which issued May 14, 1991, U.S. Pat. No. 4,889,310 to Boeshart, which issued Dec. 26, 1989, U.S. Pat. No. 4,860,515 to Browning, Jr., which issued Aug. 29, 1989, U.S. Pat. No. 4,731,968 to Obino, which issued Mar. 22, 1988, U.S. Pat. No. 4,706,429 to Young, which issued Nov. 17, 1987, U.S. Pat. No. 4,698,947 to McKay, which issued Oct. 13, 1987, U.S. Pat. No. 4,532,745 to Kinard, which issued Aug. 6, 1985, U.S. Pat. No. 4,299,070 to Oltmanns et al., which issued Nov. 10, 1981, U.S. Pat. No. 3,782,049 to Sachs, which issued Jan. 1, 1974, U.S. Pat. No. 3,668,832 to Harman, which issued Jun. 13, 1972, U.S. Pat. No. 3,509,673 to Witkosky et al., which issued May 5, 1970, U.S. Pat. No. 3,440,785 to Denny et al., which issued Apr. 29, 1969; and U.S. Pat. No. 3,438,165 to Morawski, which issued Apr. 15, 1969.

SUMMARY OF THE INVENTION

It is an object of the present invention to provide a novel wall structure fabrication system.

It is another object of the present invention to provide a wall structure fabrication system as described above which can be used easily and quickly by unskilled labor.

It is still another object of the present invention to provide a wall structure fabrication system as described above the components of which may be made of durable yet inexpensive materials.

It is still yet another object of the present invention to provide a wall structure fabrication system as described above which can be used to fabricate various types of wall structures for use in various types of settings, e.g. urban settings vs. rural settings, temperate climates vs. cold climates.

Additional objects, as well as features and advantages, of the present invention will be set forth in part in the description which follows, and in part will be obvious from the description or may be learned by practice of the invention. The objects, features, and advantages of the present invention may be realized and attained by means of the instrumentalities and combinations particularly pointed out in the appended claims.

The present invention is also directed to a novel prefabricated form for use in the above-described wall structure fabrication system. In a preferred embodiment, the prefabricated form comprises a right end panel, a left end panel, and a pair of side panels, said right end panel having a pair of L-shaped flanges and said left end panel having a pair of L-shaped slots extending outwardly therefrom and shaped so as to mate with said pair of L-shaped flanges. A pair of said prefabricated forms may be interconnected in an end-to-end relationship to provide a wall structure by inserting the pair of L-shaped flanges on the left end panel of one of said prefabricated forms into the pair of L-shaped slots on the right end panel of the other of said pair of said prefabricated forms. The right end panel, left end panel, and pair of side panels together define a cavity into which concrete or other filler material may be poured. Additionally, one or more openings may be formed on the right end and/or the left end of the prefabricated form so that concrete or the like may be distributed monolithically between adjacent forms.

The present invention also provides for a number of auxiliary components which may be used with the above-described form. These auxiliary components include a strut member which is adapted to be mounted transversely across the form for providing lateral support to the side panels, a divider panel which is adapted to be mounted longitudinally within the form for dividing the cavity into a space into which concrete or other filler materials may be poured and an insulation space, a right end member mateable with the right end panel of the form for use in containing the flow of concrete out of the openings formed in the right end panel and/or for use in joining the right end panel of one form to a side panel of a second form, a left end member mateable with the left end panel of the form for use in containing the flow of concrete out of the openings formed in the left end panel and/or for use in joining the left end panel of one form to a side panel of a second form, and a U-shaped bracket into which the form may be seated if it is to be mounted directly into the ground.

By combining a plurality of the prefabricated forms as described above with different combinations of the auxiliary components described above, a number of different wall structures may be produced, the number of parts and content of which being within the discretion of the builder.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

The present invention relates to a novel wall structure fabrication system comprising a variety of modular components which, as will hereinafter be seen, may be assembled in various ways to provide different types of wall structures.

Figure 1:
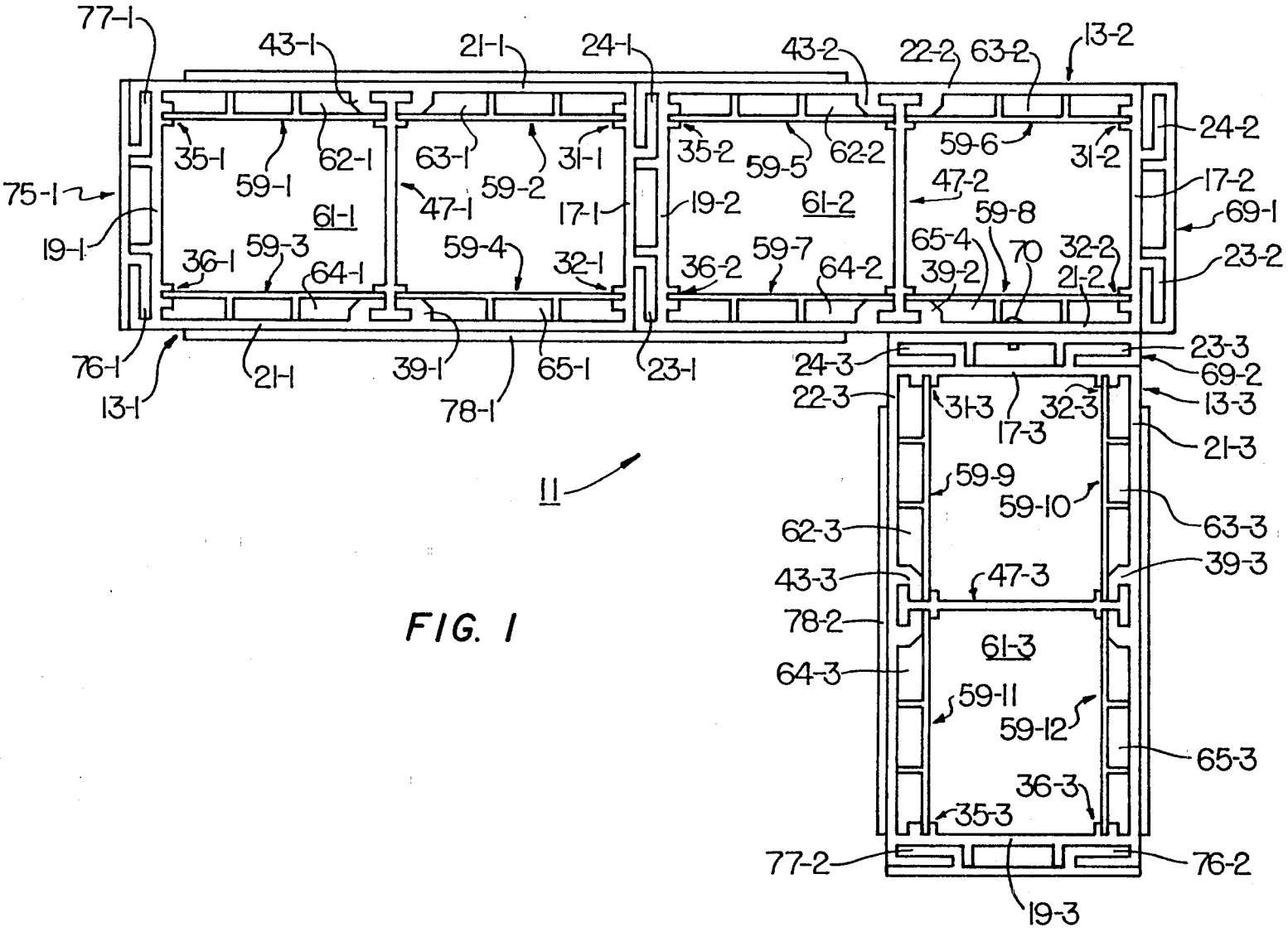
FIG. 1 is a top view of a simple wall structure fabricated using the wall structure fabrication system of the present invention.

Referring now to FIG. 1, there is shown a simple wall structure fabricated using selected components of the wall structure fabrication system of the present invention, the wall structure being represented generally by reference numeral 11, the particular wall structure shown being for illustrative purposes only.

Figure 2:
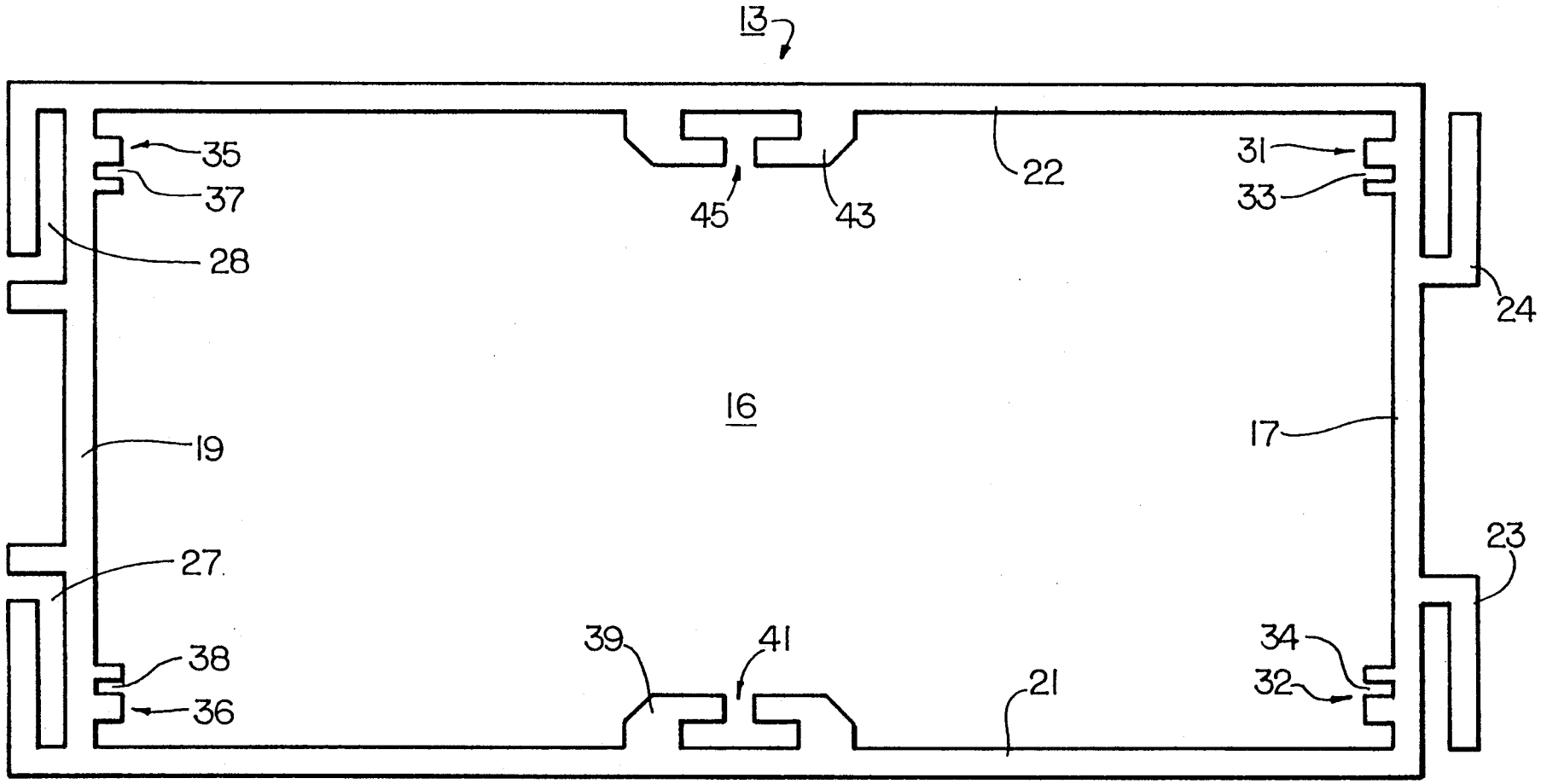
FIG. 2 is a top view of one of the prefabricated forms shown in FIG. 1.
Figure 3B:
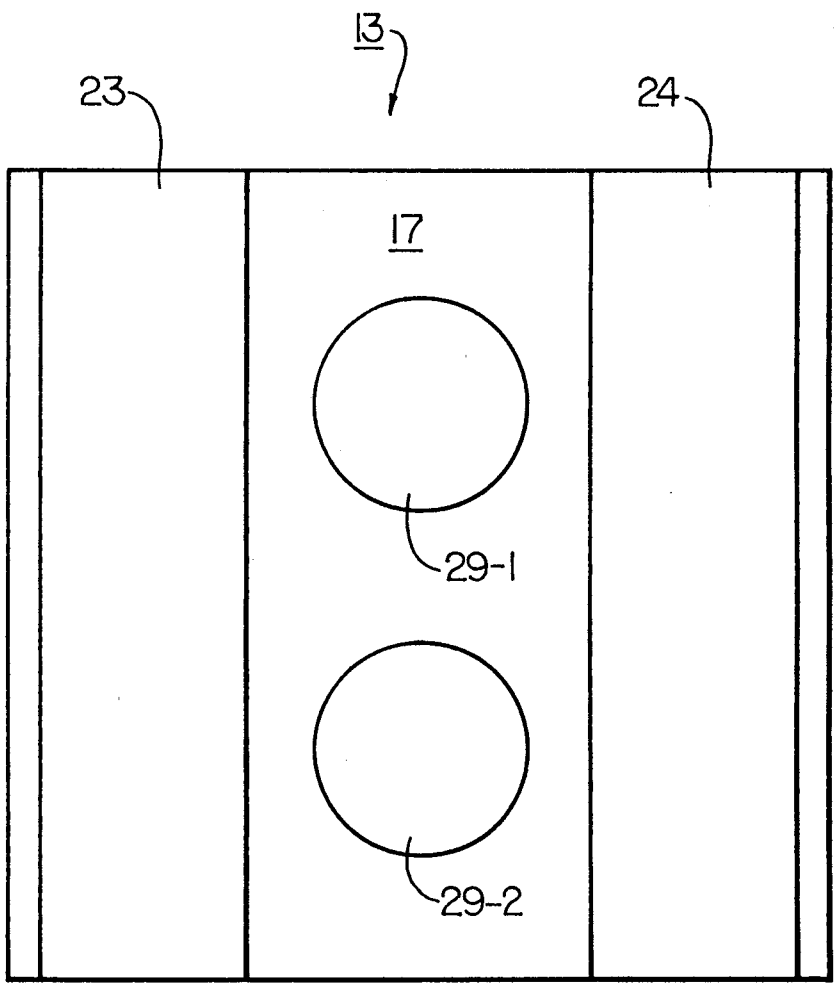
FIGS. 3(*a*) and 3(*b*) are left end and right end views, respectively, of the prefabricated form shown in FIG. 2.
Figure 3A:
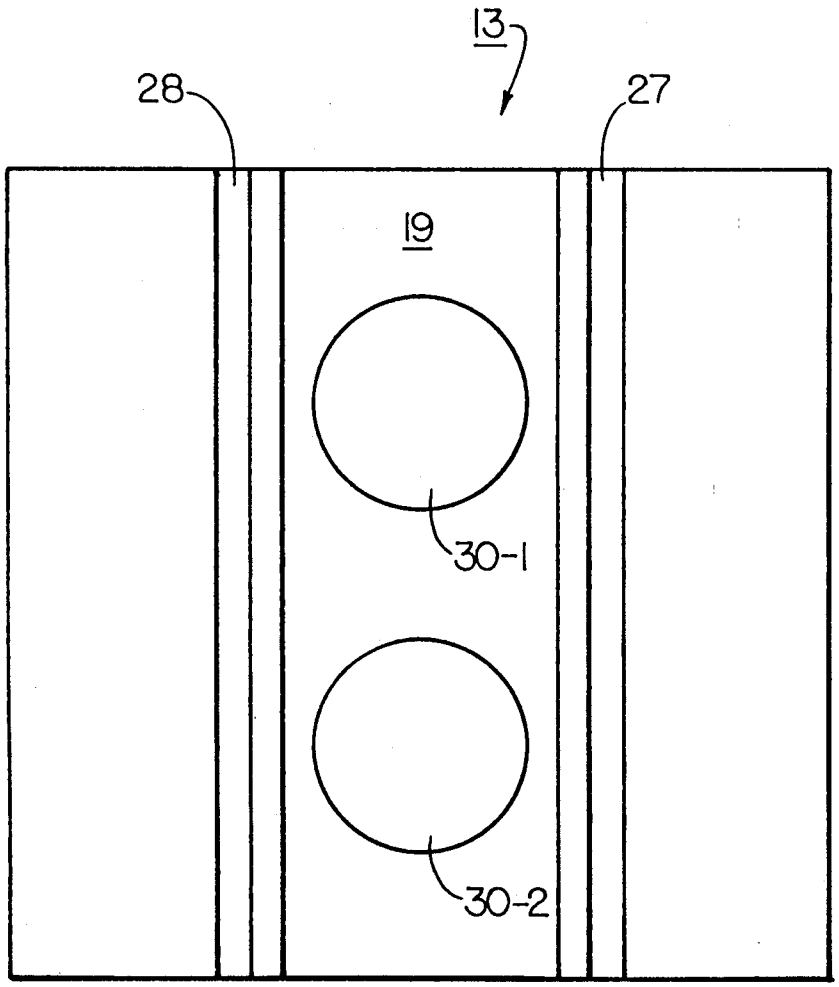

Wall structure 11 includes a plurality of prefabricated forms 13-1 through 13-3. An exemplary form 13 is shown separately in FIGS. 2 and 3. As can be seen, form 13 is an elongated, generally rectangular, unitary structure having a hollow cavity 16 adapted to receive concrete, sand, mud, gravel, or other similar materials, cavity 16 being defined by a right end panel 17, a left end panel 19, and a pair of side panels 21 and 22. The outer surface of right end panel 17 is shaped to include a pair of opposed, outwardly facing, L-shaped flanges 23 and 24, and the outer surface of left end panel 19 is shaped to include a pair of L-shaped slots 27 and 28. Slots 27 and 28 are sized and shaped to mate with flanges 23 and 24, respectively, so that a pair of forms 13 may be interconnected in an end-to-end relationship by inserting flanges 23 and 24 of one form 13 into slots 27 and 28, respectively, of a second form 13.

In addition, right end panel 17 is shaped to include a pair of openings 29-1 and 29-2, which are located between flanges 23 and 24 and through which concrete or other similar materials may pass. Left end panel 19 is similarly shaped to include a pair of openings 30-1 and 30-2, which are located between slots 27 and 28 and are used for a similar purpose. Openings 29 and 30 of end panels 17 and 19, respectively, are alignable so that, when a pair of forms 13 are interconnected in an end-to-end-relationship and concrete or other similar materials are poured into the forms, the materials are permitted to pass between adjacent forms 13 in such a way as to provide a monolithic structure.

The inner surface of end panel 17 is shaped to include a pair of embossments 31 and 32, which extend vertically downward from the top surface of end panel 17 to the bottom surface thereof. Embossments 31 and 32 are provided with longitudinally-extending slots 33 and 34, respectively, each of which is adapted to receive one end of a divider panel to be hereinafter described. The inner surface of end panel 19 is a mirror image of that of end panel 17; consequently, it also includes a pair of embossments 35 and 36, which are provided with slots 37 and 38, respectively, each of which is adapted to receive one end of a divider panel.

The inner surface of side panel 21 is shaped to include an embossment 39, which extends vertically downward from the top surface of side panel 21 to the bottom surface thereof. Embossment 39 is shaped to include a longitudinally-extending, T-shaped slot 41. As will be discussed below in greater detail, slot 41 is adapted to receive one end of a strut member to be hereinafter described. The inner surface of side panel 22 is a mirror image of that of side panel 21; consequently, it also includes an embossment 43 having a T-shaped slot 45, slot 45 being adapted to receive the opposite end of a strut member.

Figure 4:
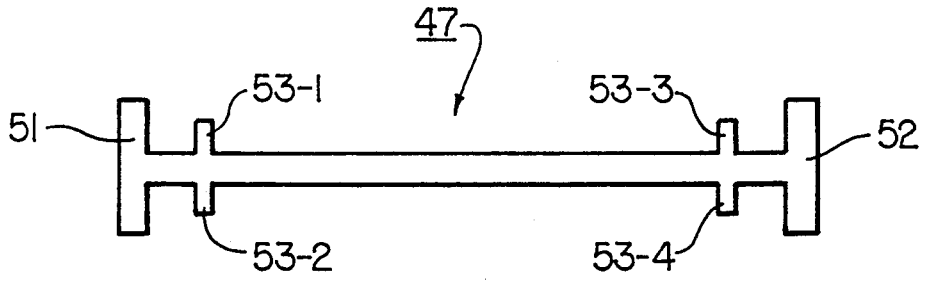
FIG. 4 is a top view of one of the strut members shown in FIG. 1.
Figure 5:
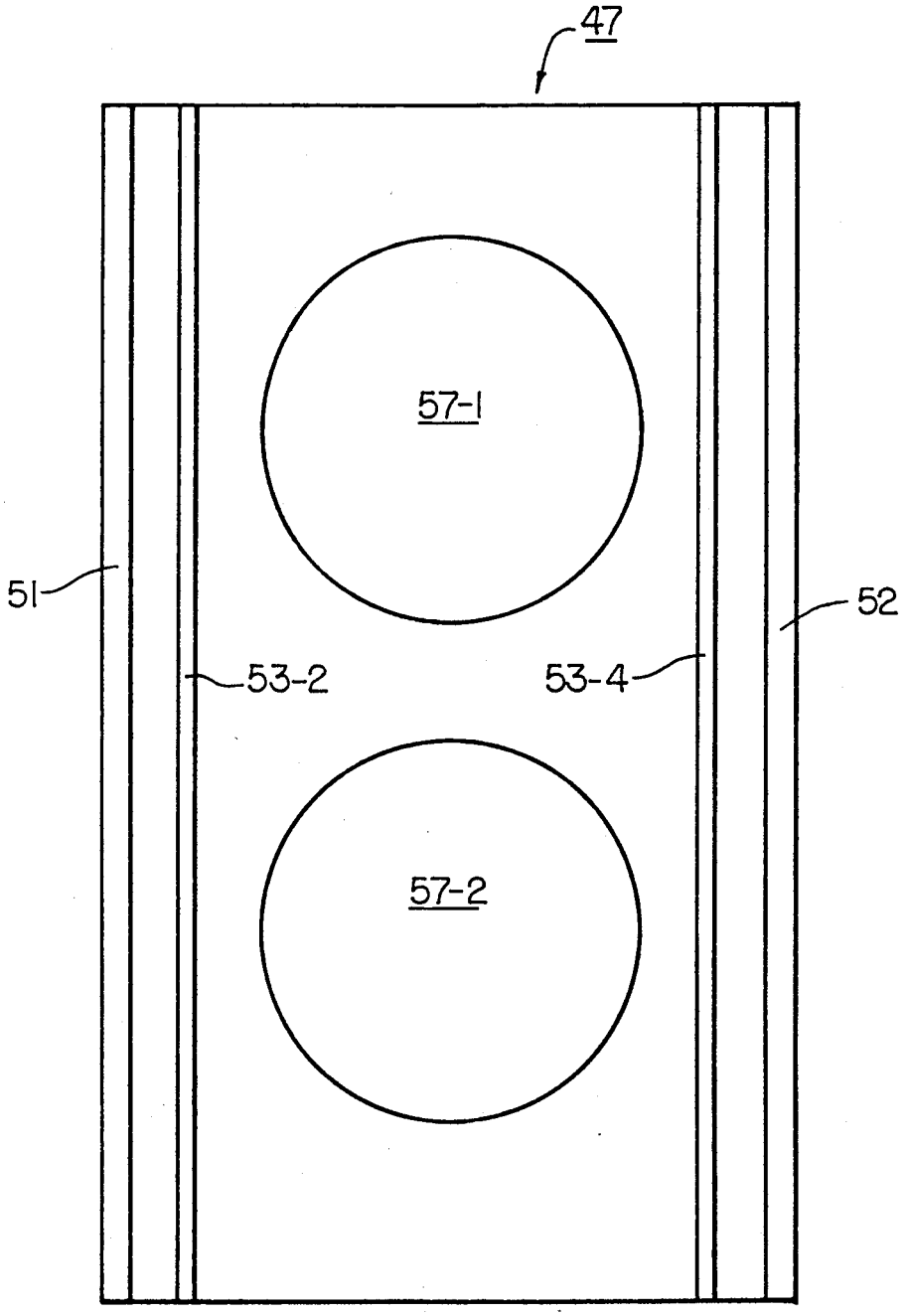
FIG. 5 is a right side view of the strut member shown in FIG. 4.

Referring back to FIG. 1, wall structure 11 can also be seen to include a plurality of strut members 47-1 through 47-3, which are transversely mounted within forms 13-1 through 13-3, respectively. An exemplary strut member 47 is shown separately in FIGS. 4 and 5. As can be seen, strut member 47 is an elongated, generally rectangular, unitary structure having a pair of T-shaped ends 51 and 52, which extend downwardly the entire vertical length of member 47. T-shaped ends 51 and 52 are mateable with slots 41 and 45, respectively, and are used to interconnect strut member 47 to side panels 21 and 22 of form 13. Strut member 47, when thus connected to form 13, serves to keep side panels 21 and 22 from spreading apart, which they might otherwise be inclined to do when concrete or the like is poured into form 13.

Figure 6:
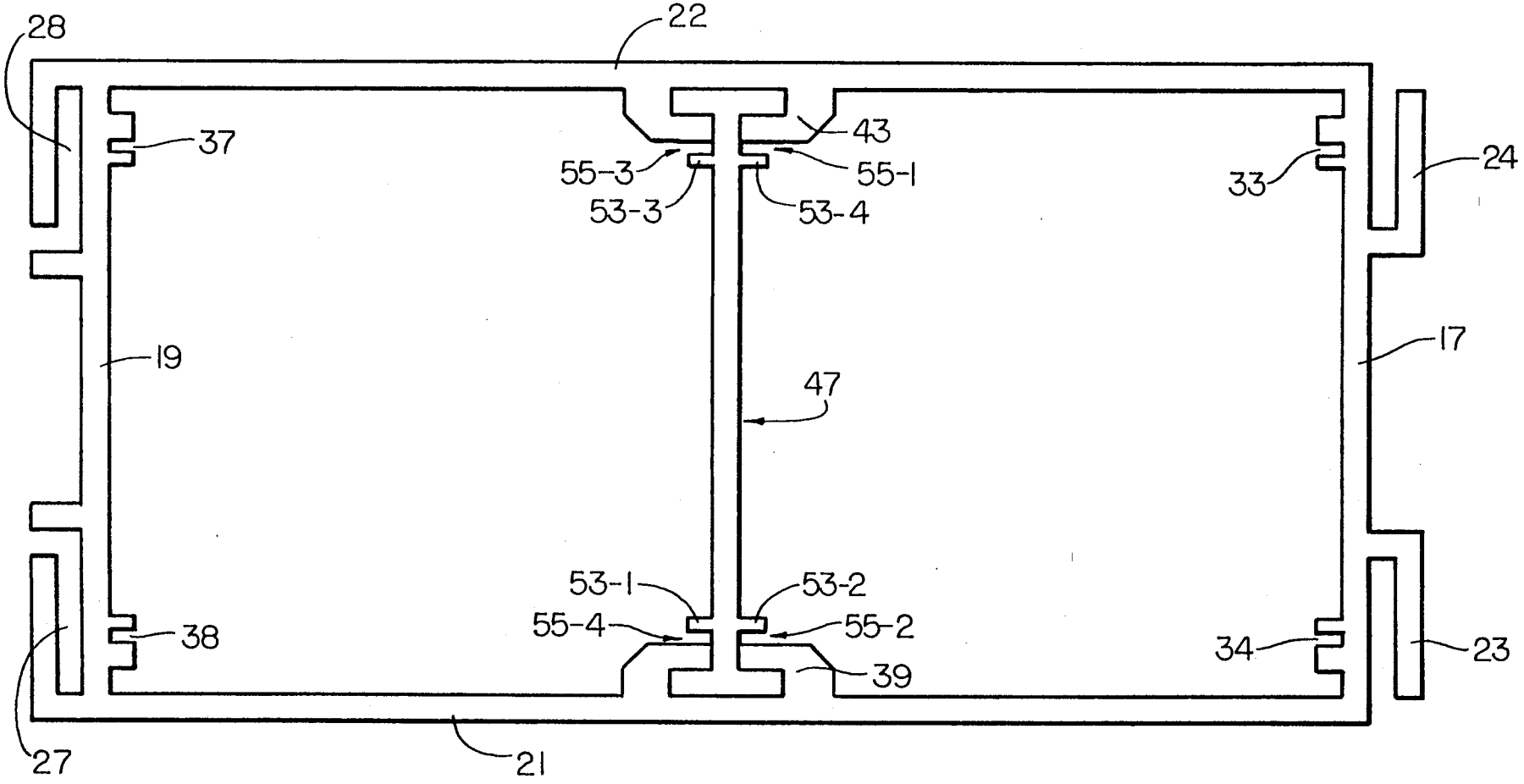
FIG. 6 is a top view of one of the prefabricated forms of FIG. 1 and one of the strut members of FIG. 1 shown in their assembled form.

Strut member 47 is also shaped to include a plurality of slats 53-1 through 53-4, which extend downwardly the entire vertical length of member 47. Slats 53-1 through 53-4 are appropriately spaced inwardly from ends 51 and 52 so that, when strut member 47 is transversely mounted within form 13, a plurality of slots 55-1 through 55-4 (see FIG. 6) are defined by slats 53-1 through 53-4 and embossments 39 and 43. Slots 55-1 through 55-4 are aligned with slots 33, 34, 37, and 38, respectively, and are adapted to receive the opposite ends of divider panels having one end mounted within slots 33, 34, 37, and 38. So as not to obstruct the flow of concrete or other similar materials poured into form 13, a pair of openings 57-1 and 57-2 are provided in the side of member 47 between slats 53.

Figure 7:
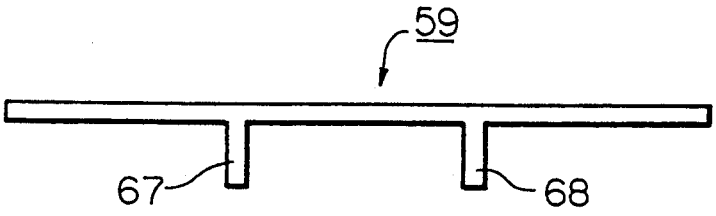
FIG. 7 is a top view of one of the divider panels shown in FIG. 1.
Figure 8:
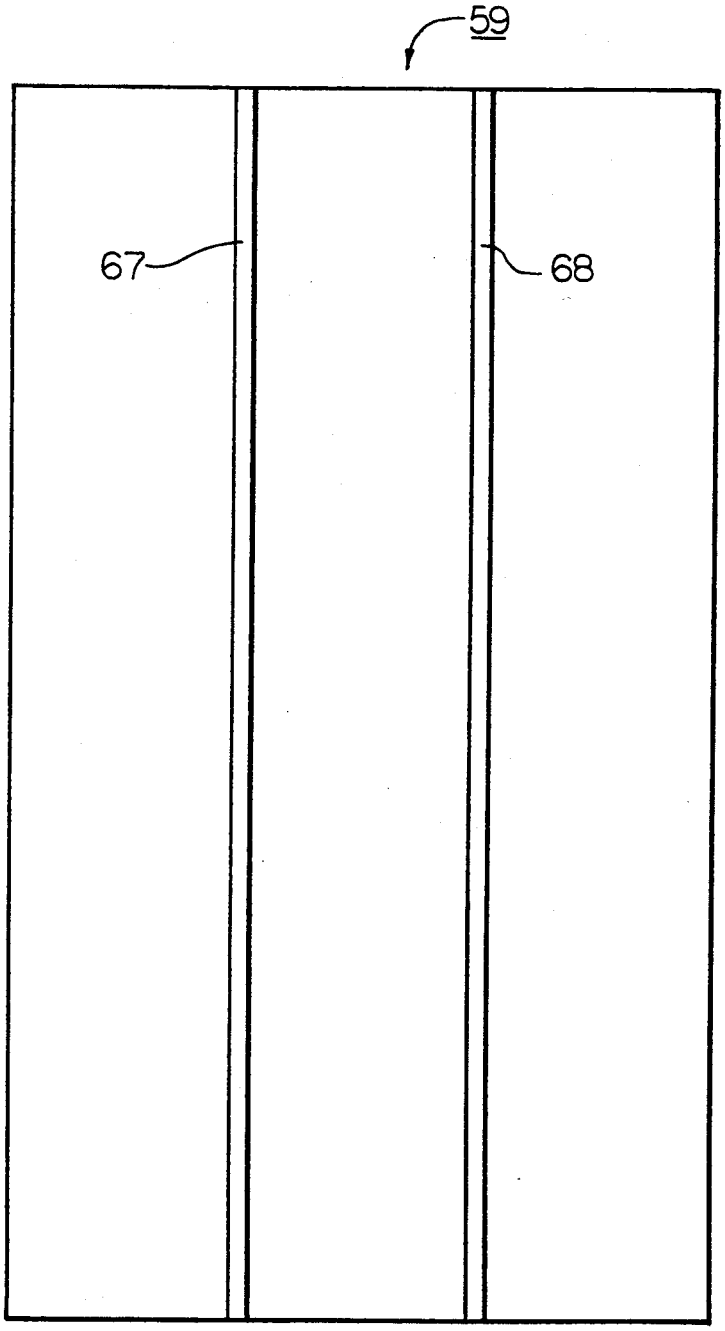
FIG. 8 is a rear view of the divider panel shown in FIG. 7.

Referring back to FIG. 1, wall structure 11 can further be seen to include a plurality of divider panels 59-1 through 59-12, panels 59-1 through 59-4 being mounted in form 13-1, panels 59-5 through 59-8 being mounted in form 13-2, and panels 59-9 through 59-12 being mounted in form 13-3. As can be seen, divider panels 59 can be used, if desired, to partition cavity 16 of form 13 into a smaller space 61 adapted to receive concrete, sand, mud, gravel, or the like, and a plurality of air spaces 62 through 65, which may be used for insulation. An exemplary divider panel 59 is shown in FIGS. 7 and 8. As can be seen, divider panel 59 is an elongated, generally rectangular, unitary structure having a pair of slats 67 and 68, which extend downwardly the entire vertical length of panel 59 on one side thereof. Slats 67 and 68 are made to extend sufficiently outwardly so that, when panel 59 is mounted in form 13, the inner surface of side panel 21 or 22 is engaged thereby. In this way, panel 59 is kept from being bent outwardly due to the weight of concrete or the like poured into space 61. Similarly, slats 67 and 68 provide support to side panels 21 and 22 to keep them from being pushed inwardly by an external force directed thereto.

Figure 9:
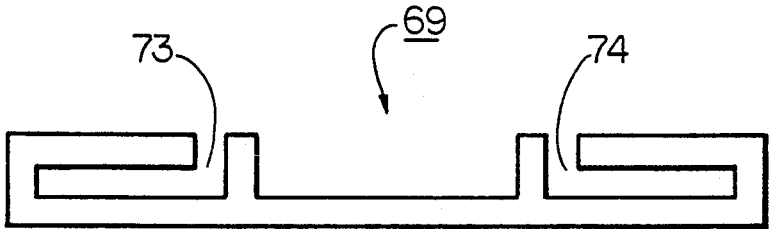
FIG. 9 is a top view of the right end member shown in FIG. 1.
Figure 10:
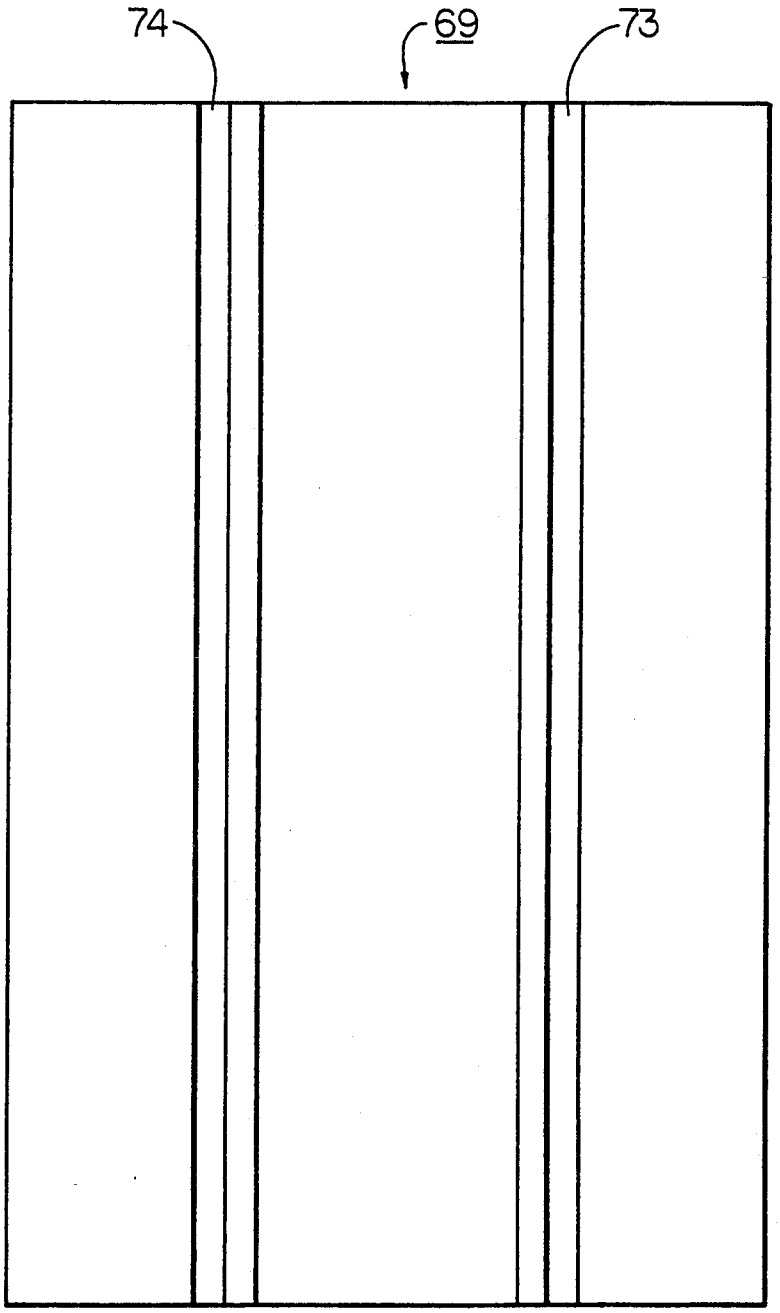
FIG. 10 is a left end view of the right end member shown in FIG. 9.

Referring back to FIG. 1, wall structure 11 can further be seen to include a pair of right end members 69-1 and 69-2. Member 69-1 is connected to right end panel 17-2 of form 13-2 and acts as a plug to contain the flow of concrete or other filler materials out of openings 29-1 and 29-2 of panel 17-2. Member 69-2 is fixedly attached to side panel 21-2 of form 13-2 by a screw 70 or the like and is connected to right end panel 17-3 of form 13-3 so as to join forms 13-2 and 13-3 in an end-to-side fashion. Member 69 is shown separately in FIGS. 9 and 10. As can be seen, member 69 is an elongated, generally rectangular, unitary panel structure shaped to include a pair of L-shaped slots 73 and 74, slots 73 and 74 being sized and shaped to mate with L-shaped flanges 23 and 24, respectively, of form 13.

Figure 11:
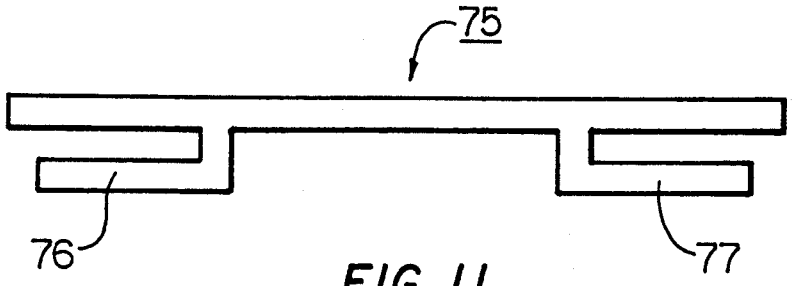
FIG. 11 is a top view of one of the left end members shown in FIG. 1.
Figure 12:
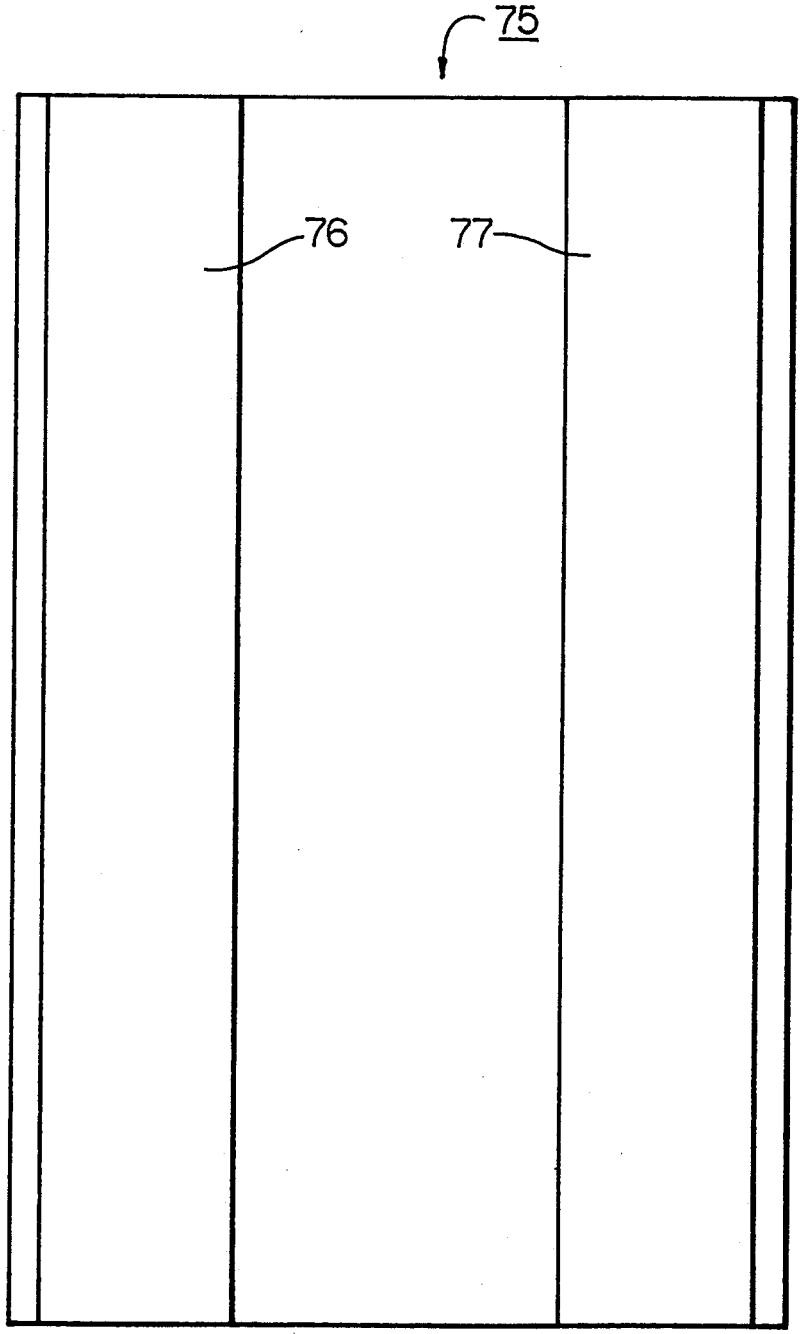
FIG. 12 is a right end view of the left end member shown in FIG. 11.

Referring back to FIG. 1, wall structure 11 can further be seen to include a pair of left end members 75-1 and 75-2. Member 75-1 is connected to left end panel 19-1 of form 13-1 and acts as a plug to contain the flow of concrete or other filler materials out of openings 30-1 and 30-2 in panel 19-1. Member 75-2 is connected to left end panel 19-3 of form 13-3 and similarly acts as a plug to contain the flow of concrete or the like out of openings 30-1 and 30-2 in panel 19-3. An exemplary member 75 is shown separately in FIGS. 11 and 12. As can be seen, member 75 is an elongated, generally rectangular, unitary panel structure shaped to include a pair of opposed, outwardly facing, L-shaped flanges 76 and 77, which are mateable with slots 27 and 28, respectively, of form 13. As can readily be appreciated, in addition to being used as a plug, member 75 can also be fixedly attached to the side of a form 13, in the same manner as discussed above with member 69-2, for the purpose of joining together a pair of forms 13 in an end-to-side fashion.

Figure 13:
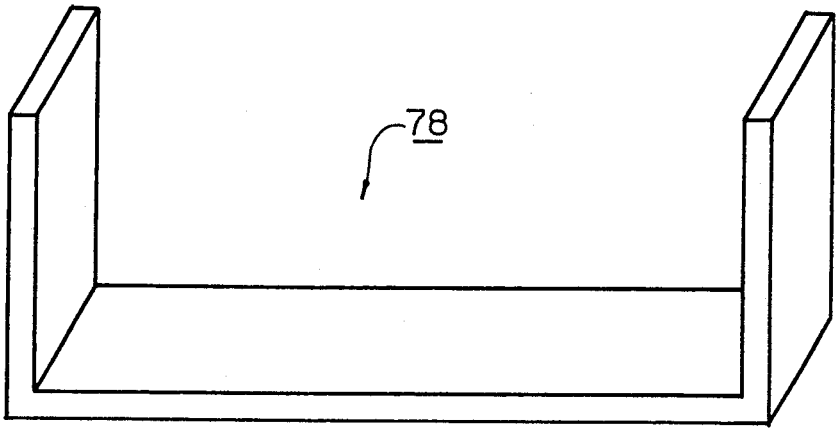
FIG. 13 is an end perspective view of one of the shoe members shown in FIG. 1.

Referring back to FIG. 1, wall structure 11 can further be seen to include a pair of U-shaped brackets 78-1 and 78-2. Forms 13-1 and 13-2 are seated within bracket 78-1, and form 13-3 is seated within bracket 78-2. An exemplary bracket 78 is shown separately in FIG. 13. As can readily be appreciated, in those situations in which wall structure 11 is mounted directly into the ground, as opposed to being inserted into a concrete pad or other foundation, bracket 78 provides a level base upon which forms 13 may rest and serves to keep concrete and the like from falling out of the bottom of forms 13. In those situations where a concrete pad or a similar foundation is provided, bracket 78 need not be placed under forms 13.

Forms 13, strut members 47, panel members 59, right end members 69, left end members 75, and brackets 78 are all preferably made from extrusions of polyvinyl chloride, polyurethane, or the like; however, foamed plastics, injection molded plastics, metals, and other similar materials may also be used. As can readily be understood, the dimensions of the foregoing components of the present system may be varied to suit the particular needs of the end-user. Nevertheless, it has been found to be particularly desirable for forms 13 to be about 12 inches long, 6 inches wide, and about 8 feet high, with the other components being proportionately dimensioned.

Figure 14:
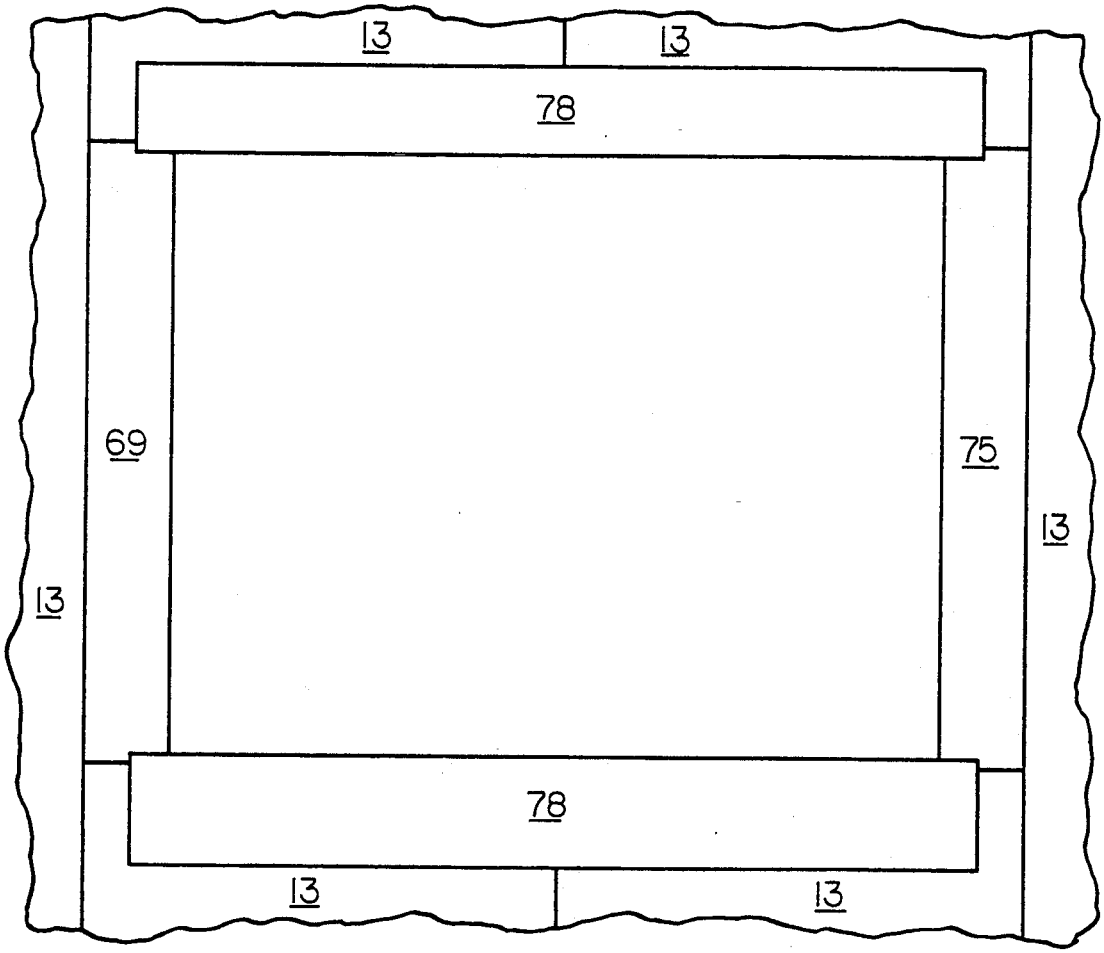
FIG. 14 is a simplified side view illustrating how certain components of the present system can be combined to construct a window frame.

As can readily be appreciated, wall structures of various configurations can be fabricated by assembling the foregoing components in a variety of ways. Buildings, such as simple dwellings, may be fabricated by attaching a simple roof to a wall structure configured to define an enclosed area. Spaces for windows and/or doors can easily be incorporated into the wall structure by interconnecting one or more forms 13 that are less than full-length between a pair of full-length forms 13 and using end members 69 and 75 and brackets 78 as seen in FIG. 14. Where the wall structure is to be used in a temperate climate, panels 59 need not be used, and concrete or the like may be poured only into those forms 13 located in the corners, or used to support the windows and doors. In colder climates, however, panels 59 are preferably used to define an insulation space, and concrete is preferably poured into all of the forms 13.

The embodiments of the present invention recited herein are intended to be merely exemplary and those skilled in the art will be able to make numerous variations and modifications to it without departing from the spirit of the present invention. For example, where right end member 69 or left end member 75 is fixedly attached to one of the side panels 21 or 22 of a first form 13 for the purpose of joining the first form 13 to a second form 13 in an end-to-side relationship, one could provide corresponding openings in the respective sides of right end member 69 or left end member 75 and first form 13 so that concrete or the like can be distributed monolithically between the first form 13 and the second form 13. All such variations and modifications are intended to be within the scope of the present invention as defined by the claims appended hereto.

What is claimed is:

1. A prefabricated wall structure kit comprising a pair of identical forms, each of said pair of identical forms comprising a generally rectangular elongated structure having a cavity defined by a right end panel, a left end panel and a pair of side panels, said right end panel and said left end panel being matingly engageable so that said pair of identical forms may be interconnected in an end-to-end relationship, said right end panel and said left end panel also being provided with alignable openings so that, when said pair of identical forms are interconnected in an end-to-end relationship, said right end panel and said left end panel also being provided with alignable openings so that, when said pair of identical forms are interconnected in an end-to-end relationship, concrete may be distributed monolithically between said pair of identical forms, a right end member and a left end member, said right end member being matingly engageable with said right end panel of said pair of identical forms and being appropriately shaped to contain concrete which has passed through said alignable opening in said right end panel, said left end member being matingly engageable with said left end panel of said pair of identical forms and being appropriately shaped to contain concrete which has passed through said alignable opening in said left end panel.

2. The prefabricated wall structure kit as claimed in claim 1 further comprising divider panels mountable longitudinally within said cavities of said pair of identical forms for dividing each of said cavities into a concrete-receiving space and one or more insulation-receiving spaces.

3. The prefabricated wall structure kit as claimed in claim 2 further comprising strut members mountable transversely across said cavities of said pair of identical forms for providing lateral support thereto.

* * * * *